US006539199B1

(12) United States Patent
Miyata et al.

(10) Patent No.: US 6,539,199 B1
(45) Date of Patent: Mar. 25, 2003

(54) IMAGE FORMING DEVICE AND METHOD CAPABLE OF CORRECTING LATERAL MISALIGNMENT

(75) Inventors: Shungo Miyata, Tokyo (JP); Kazumasa Yasui, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/972,922

(22) Filed: Oct. 10, 2001

(51) Int. Cl.[7] ..... G03G 15/00

(52) U.S. Cl. ..... 399/394; 347/248; 399/16; 399/389

(58) Field of Search ..... 399/394, 395, 399/396, 389, 16; 347/129, 153, 248, 262; 358/406, 504; 271/265.01, 265.03

(56) References Cited

U.S. PATENT DOCUMENTS 4,099,214 A * 7/1978 Jones ..... 399/16 X
6,137,989 A * 10/2000 Quesnel ..... 347/248
6,340,984 B1 * 1/2002 Ui et al. ..... 399/394 X
6,342,909 B1 * 1/2002 Joichi et al. ..... 347/129

FOREIGN PATENT DOCUMENTS

| | | | |
|---|---|---|---|
| JP | 03-012668 | * | 1/1991 |
| JP | 5-210285 | | 8/1993 |
| JP | 05-338859 | * | 12/1993 |
| JP | 2000-034039 | * | 2/2000 |

* cited by examiner

*Primary Examiner*—Sophia S. Chen
(74) *Attorney, Agent, or Firm*—Foley & Lardner

(57) ABSTRACT

A sheet feeding unit is provided with a feeding path, on which a cut sheet having a predetermined size is fed. A sheet edge sensor has sensor elements separately arranged at portions, at which the edge of the cut sheet can be detected, along a direction perpendicular to the feeding direction of the cut sheet. An image forming unit forms a predetermined image on the cut sheet. An image formation correcting unit corrects image formation according to lateral misalignment of the cut sheet based on a detection result transmitted from the sheet edge sensor when a predetermined image is formed on the cut sheet.

10 Claims, 8 Drawing Sheets

IMAGE FORMING DEVICE AND METHOD CAPABLE OF CORRECTING LATERAL MISALIGNMENT

BACKGROUND OF THE INVENTION

The present invention relates to an image forming apparatus and, more particularly, to an image forming apparatus such as an electronic copying machine, a digital copying machine (PPC), a printer or a facsimile for forming an image of a document on a cut sheet serving as an image forming medium, in which the image of the document can be formed at a correct position by correcting lateral misalignment of the cut sheet serving as the image forming medium which is supplied and fed to an image forming unit, and a method for controlling the image forming apparatus.

As is well known, the image forming apparatus such as an electronic copying machine, a digital copying machine (PPC), a printer or a facsimile is designed such that an image of a document can be formed on a cut sheet serving as an image forming medium which is supplied and fed to an image forming unit provided with a laser printer.

In this case, if there is lateral misalignment of the cut sheet fed to the image forming unit, the image of the document cannot be formed at a correct position on the cut sheet.

Such lateral misalignment is liable to become large in the case where the cut sheet is fed in a direction perpendicular to the width direction of the cut sheet.

In view of this, in an electrophotographic printing apparatus disclosed in Jpn. Pat. Appln. KOKAI Publication No. 5-210285, there is provided a sheet edge sensor consisting of an array of light emitting elements and an array of light receiving elements arranged along the entire width in a direction perpendicular to a sheet feeding direction on a sheet feeding path, i.e., in a lateral direction of the sheet, for detecting misalignment in the direction of the width of the sheet, such that a laser printer in an image forming unit is controlled based on the detection result, thus correcting a position at which an electrostatic latent image is formed on a photosensitive drum.

In this manner, when the electrostatic latent image formed on the photosensitive drum is transferred onto a cut sheet serving as an image forming medium with a toner, a correct image of a document without any misalignment can be formed even on the cut sheet serving as the image forming medium having lateral misalignment.

However, since the sheet edge sensor consisting of the array of the light emitting elements and the array of the light receiving elements arranged along the entire width in the direction perpendicular to the sheet feeding direction on the sheet feeding path, i.e., in the lateral direction of the sheet is used as a sensor element in the above-described prior art, the sensor is redundantly configured such that the sensor elements are arranged even at portions where the cut sheet serving as the image forming medium having a size previously designated by a user is not actually fed.

There arise problems of much waste and an increase in cost by using the sheet edge sensor having the redundant configuration in which the sensor elements are arranged even at the portions where the cut sheet having the designated size is not actually fed.

Furthermore, if there is a smear caused by sheet leavings on the feeding path at the portion at which the sheet edge sensor is disposed, the conventional sheet edge sensor may erroneously detect the sheet at that portion.

Moreover, if a portion colored with a smear or the like is judged on a white-and-black criterion in the case where the conventional sheet edge sensor is a reflection type detecting sensor, the sensor may erroneously judge that a white sheet partly colored with a smear or the like is black as a whole.

Additionally, the image forming unit provided with the laser printer may over-correct the misalignment in the case where the conventional sheet edge sensor cannot detect a sheet edge for some accidental reasons, or the detection result differs greatly from the actual misalignment.

BRIEF SUMMARY OF THE INVENTION

An object of the present invention is to provide an image forming apparatus capable of correcting lateral misalignment in such a manner that a correct image of a document without any misalignment can be formed even on a cut sheet serving as an image forming medium having lateral misalignment, by means of an inexpensive and compact sheet edge sensor mechanism by detecting the edge of the cut sheet serving as the image forming medium by the use of sensor elements separately arranged at portions at which the sensor elements are actually used according to the size of the cut sheet serving as the image forming medium, and a method for controlling the image forming apparatus.

Another object of the present invention is to provide an image forming apparatus capable of correcting lateral misalignment in such a manner that a correct image of a document without any misalignment can be formed even on a cut sheet serving as an image forming medium having lateral misalignment, by means of an inexpensive and compact sheet edge sensor mechanism, by detecting the edge of the cut sheet serving as the image forming medium by the use of a sensor element movably arranged at a portion at which the sensor element is actually used according to the size of the cut sheet serving as the image forming medium, and a method for controlling the image forming apparatus.

In this case, it is to be understood that the sensor elements are arranged not only in the direction of the width of the sheet but also at portions requiring accuracy.

Furthermore, according to the present invention, a judgment criterion is previously corrected based on the current state of the sensor, thereby reducing erroneous detection.

Moreover, according to the present invention, a mechanism for removing a smear on the glass stage on which a document is placed can be eliminated, thereby achieving cost reduction as a whole.

Additionally, according to the present invention, information on the color of the sheet to be used is previously acquired, and thus, a judgment criterion corresponding to the color is used, thereby eliminating erroneous detection caused by a difference in color of the sheet.

In addition, according to the present invention, there is provided a limitation in the case where misalignment exceeds an estimated value, thereby minimizing over-correction.

In order to achieve the above-described objects, according to the present invention:

(1) There is provided an image forming apparatus comprising:

- a sheet feeding unit provided with a feeding path, on which a cut sheet serving as an image forming medium having a predetermined size is fed;
- a sheet edge sensor having sensor elements separately arranged at portions, at which the edge of the cut sheet serving as the image forming medium having the predetermined size can be detected, along a direction perpendicular to the feeding direction of the cut sheet serving as the image forming medium on the feeding path in the sheet feeding unit;

an image forming unit for forming a predetermined image on the cut sheet serving as the image forming medium to be fed by the sheet feeding unit; and an image formation correcting unit for correcting image formation according to lateral misalignment of the cut sheet serving as the image forming medium based on a detection result transmitted from the sheet edge sensor when a predetermined image is formed on the cut sheet serving as the image forming medium by the image forming unit.

In order to achieve the above-described objects, according to the present invention:

(2) There is provided an image forming apparatus according to (1), wherein when the presence of the sheet is detected based on the detection result transmitted from the sheet edge sensor, the image formation correcting unit adjusts a threshold as a judgment criterion of the presence of the sheet before actual detection of the sheet by the sheet edge sensor.

In order to achieve the above-described objects, according to the present invention:

(3) There is provided an image forming apparatus according to (2), wherein when the presence of the sheet is detected based on the detection result transmitted from the sheet edge sensor, the image formation correcting unit previously designates the color of the sheet, and then, resets the threshold as the judgment criterion of the presence of the sheet in accordance with the designated color.

In order to achieve the above-described objects, according to the present invention:

(4) There is provided an image forming apparatus according to (1), wherein when the amount of lateral misalignment of the sheet is corrected based on the detection result transmitted from the sheet edge sensor, the image formation correcting unit judges as to whether or not the detected amount of misalignment exceeds a predetermined value, and then, gives a limitation to correction of the lateral misalignment of the sheet in the case where the detected amount of misalignment exceeds the predetermined value.

In order to achieve the above-described objects, according to the present invention:

(5) There is provided an image forming apparatus comprising:

a sheet feeding unit provided with a feeding path, on which a cut sheet serving as an image forming medium having a predetermined size is fed;

a sheet edge sensor having a sensor element movably arranged at a portion, at which the edge of the cut sheet serving as the image forming medium having the predetermined size can be detected, along a direction perpendicular to the feeding direction of the cut sheet serving as the image forming medium on the feeding path in the sheet feeding unit;

an image forming unit for forming a predetermined image on the cut sheet serving as the image forming medium to be fed by the sheet feeding unit; and an image formation correcting unit for correcting image formation according to lateral misalignment of the cut sheet serving as the image forming medium based on a detection result transmitted from the sheet edge sensor when a predetermined image is formed on the cut sheet serving as the image forming medium by the image forming unit.

In order to achieve the above-described objects, according to the present invention:

(6) There is provided an image forming apparatus according to (5), wherein when the presence of the sheet is detected based on the detection result transmitted from the sheet edge sensor, the image formation correcting unit adjusts a threshold as a judgment criterion of the presence of the sheet before actual detection of the presence of the sheet by the sheet edge sensor.

In order to achieve the above-described objects, according to the present invention:

(7) There is provided an image forming apparatus according to (6), wherein when the presence of the sheet is detected based on the detection result transmitted from the sheet edge sensor, the image formation correcting unit previously designates the color of the sheet, and then, resets the threshold as the judgment criterion of the presence of the sheet in accordance with the designated color.

In order to achieve the above-described objects, according to the present invention:

(8) There is provided an image forming apparatus according to (5), wherein when the amount of lateral misalignment of the sheet is corrected based on the detection result transmitted from the sheet edge sensor, the image formation correcting unit judges as to whether or not the detected amount of misalignment exceeds a predetermined value, and then, gives a limitation to correction of the lateral misalignment of the sheet in the case where the detected amount of misalignment exceeds the predetermined value.

In order to achieve the above-described objects, according to the present invention:

(9) There is provided a method for controlling an image forming apparatus comprising the steps of:

feeding a cut sheet serving as an image forming medium having a predetermined size along a feeding path provided in a sheet feeding unit;

separately arranging sensor elements constituting a sheet edge sensor at portions, at which the edge of the cut sheet serving as the image forming medium having the predetermined size can be detected, along a direction perpendicular to the feeding direction of the cut sheet serving as the image forming medium on the feeding path in the sheet feeding unit;

forming a predetermined image on the cut sheet serving as the image forming medium to be fed to an image forming unit by the sheet feeding unit; and correcting image formation according to lateral misalignment of the cut sheet serving as the image forming medium based on a detection result transmitted from the sheet edge sensor when a predetermined image is formed on the cut sheet serving as the image forming medium by the image forming unit.

In order to achieve the above-described objects, according to the present invention:

(10) There is provided a method for controlling an image forming apparatus according to (9), wherein when the presence of the sheet is detected based on the detection result transmitted from the sheet edge sensor, a threshold as a judgment criterion of the presence of the sheet is adjusted in the image formation correcting step before actual detection of the presence of the sheet by the sheet edge sensor.

In order to achieve the above-described objects, according to the present invention:

(11) There is provided a method for controlling an image forming apparatus according to (10), wherein when the presence of the sheet is detected based on the detection result transmitted from the sheet edge sensor, the color of the sheet is previously designated, and then, the threshold as the judgment criterion of the presence of the sheet is reset in accordance with the designated color in the image formation correcting step.

In order to achieve the above-described objects, according to the present invention:

(12) There is provided a method for controlling an image forming apparatus according to (9), wherein when the amount of lateral misalignment of the sheet is corrected based on the detection result transmitted from the sheet edge sensor, it is judged as to whether or not the detected amount of misalignment exceeds a predetermined value, and then, a limitation is given to correction of the lateral misalignment of the sheet in the case where the detected amount of misalignment exceeds the predetermined value in the image formation correcting step.

In order to achieve the above-described objects, according to the present invention:

(13) There is provided a method for controlling an image forming apparatus comprising the steps of:

feeding a cut sheet serving as an image forming medium having a predetermined size along a feeding path provided in a sheet feeding unit;

moving a sensor element constituting a sheet edge sensor at a portion, at which the edge of the cut sheet serving as the image forming medium having the predetermined size can be detected, along a direction perpendicular to the feeding direction of the cut sheet serving as the image forming medium on the feeding path in the sheet feeding unit;

forming a predetermined image on the cut sheet serving as the image forming medium to be fed to an image forming unit by the sheet feeding unit; and correcting image formation according to lateral misalignment of the cut sheet serving as the image forming medium based on a detection result transmitted from the sheet edge sensor when a predetermined image is formed on the cut sheet serving as the image forming medium by the image forming unit.

In order to achieve the above-described objects, according to the present invention:

(14) There is provided a method for controlling an image forming apparatus according to (13), wherein when the presence of the sheet is detected based on the detection result transmitted from the sheet edge sensor, a threshold as a judgment criterion of the presence of the sheet is adjusted in the image formation correcting step before actual detection of the presence of the sheet by the sheet edge sensor.

In order to achieve the above-described objects, according to the present invention:

(15) There is provided a method for controlling an image forming apparatus according to (14), wherein when the presence of the sheet is detected based on the detection result transmitted from the sheet edge sensor, the color of the sheet is previously designated, and then, the threshold as the judgment criterion of the presence of the sheet is reset in accordance with the designated color in the image formation correcting step.

In order to achieve the above-described objects, according to the present invention:

(16) There is provided a method for controlling an image forming apparatus according to (13), wherein when the amount of lateral misalignment of the sheet is corrected based on the detection result transmitted from the sheet edge sensor, it is judged as to whether or not the detected amount of misalignment exceeds a predetermined value, and then, a limitation is given to correction of the lateral misalignment of the sheet in the case where the detected amount of misalignment exceeds the predetermined value in the image formation correcting step.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiment of the invention and, together with the general description given above and the detailed description of the preferred embodiment given below, serve to explain the principles of the invention.

DETAILED DESCRIPTION OF THE INVENTION

Figure 1:
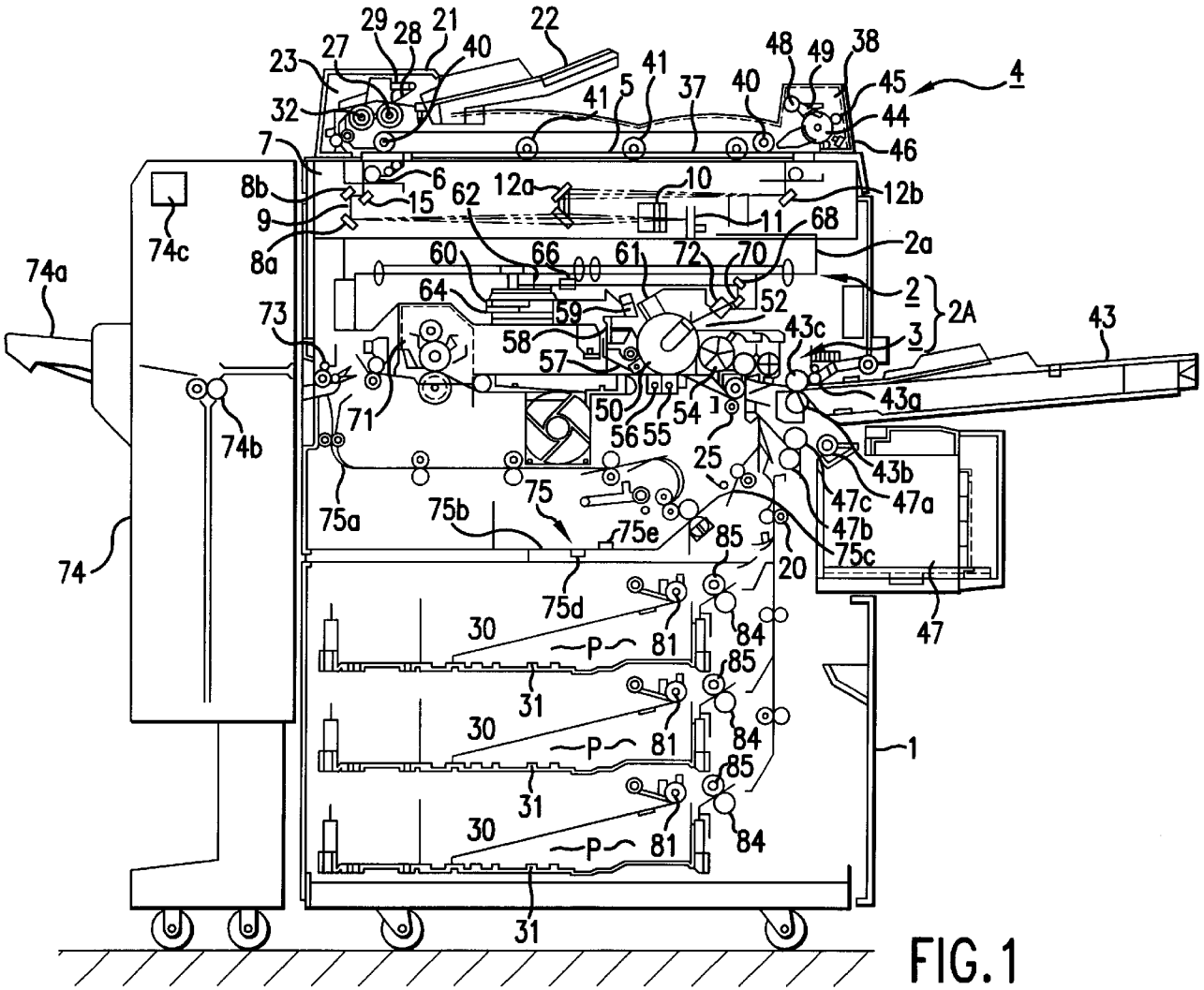
FIG. 1 is a view schematically showing the entire configuration of a digitally composite machine as one type of composite image forming apparatus which is used as an image forming apparatus according to the present invention.

Reference will now be made in detail to the presently preferred embodiments of the invention as illustrated in the accompanying drawings, in which like reference numerals designate like or corresponding parts.

Preferred embodiments in which an image forming apparatus according to the present invention is applied to a digitally composite machine will be described in reference to the accompanying drawings.

FIG. 1 is a view schematically showing the entire configuration of a digital copying machine 1 as one type of composite image forming apparatus which is used as an image forming apparatus according to the present invention (hereinafter referred to as the composite image forming apparatus, the image forming apparatus or the digitally composite machine case by case).

The digitally composite machine 1 is provided with a scanner 2 and a printer (a laser engine) 3, and further, with an automatic document feeder (ADF) 4 at the upper portion thereof.

The automatic document feeder 4 is configured such that the rear edge of a cover body 21 serving as a casing is pivotably fixed to the rear edge of the upper surface of the feeder via a hinge, not shown, and further, the entire automatic document feeder 4 is turned and displaced, as required, to release the upper portion of a document stage 5.

Slightly to the right of the cover body 21 is provided a document supplying tray 22 capable of holding therein a plurality of sheets of documents.

At one end of the feeder is disposed a supplier 23 for taking out the documents one by one and supplying them to one end (to a left end in FIG. 1) of the document stage 5.

The supplier 23 includes a pick-up roller 27 for taking out the document, a weight plate 28 for pressing the document against the pick-up roller 27, an empty sensor 29 serving as a document detecting sensor for detecting the set state of the document on the document supplying tray 22, and the like.

Furthermore, a sheet supplying roller 32 is disposed in the document taking-out direction of the pick-up roller 27, so as to securely supply and feed the documents one by one.

At the upper surface of the document stage 5 is stretched a document conveying belt 37 in such a manner as to cover the document stage 5.

The document conveying belt 37 is a wide endless belt which has a white obverse surface and is stretched across a pair of belt rollers 40 and 40, and is configured such that it can travel forward and reversely by means of a belt drive mechanism, not shown.

At the reverse surface at the inner circumference of the document conveying belt 37 are disposed a plurality of belt pressing rollers 41 . . . for pressing the belt surface on the document stage 5 and a set switch, not shown, for detecting the open/closed state of the automatic document feeder.

The document, which has been supplied and fed by the supplier 23, is fed from one end (i.e., the left end) of the document stage 5 to the other end (i.e., a right end).

A sheet discharging device 38 disposed at a right portion of the feeder includes a feeding roller 44, a pinch roller 45 for pressing the document against the feeding roller 44, a sheet discharging sensor 46 serving as a document detector for detecting the rear end of the document which is fed in a sheet discharging direction, and the like.

Furthermore, a sheet discharging roller 48 is disposed downstream of a document discharging path.

Moreover, a gate 49 for leading the document upside down to the document stage 5 is provided on the document discharging path, thereby achieving double-sided copying of the document.

The scanner 2 serving as a reader comprises: an exposure lamp 6 serving as a light source, a first carriage 7 having a mirror 15, a second carriage 9 having mirrors 8*a* and 8*b* for refracting an optical path, a lens 10, a CCD sensor 11 for receiving reflected light, a drive system, not shown, for changing the positions of the above-described constituent parts, and an A/D converter, not shown, for converting an output from the CCD sensor 11, i.e., analog image data (information) into digital image data.

The first and second carriages 7 and 9 are connected via a timing belt, not shown. The second carriage 9 is moved at a rate half of that of the first carriage 7 in the same direction as that of the first carriage 7.

Consequently, scanning can be performed in such a manner that the length of the optical path up to the lens 10 becomes constant.

The lens 10 has a fixed focal distance, and is designed to be moved in a direction of an optical axis at the time of scaling.

One pixel of the document corresponds to one element of the CCD sensor 11.

An output from the CCD sensor 11 is input into the A/D converter.

The first and second carriages 7 and 9 and the mirrors 12*a* and 12*b* are moved by stepping motors, not shown, respectively.

The first and second carriages 7 and 9 are configured to be moved in accordance with the operation of a timing belt, not shown, stretched between a drive pulley, not shown, connected to the rotary shaft of the stepping motor and an idle pulley, not shown.

When a spiral shaft, not shown, is rotated by a stepping motor, not shown, corresponding to the shaft, the lens 10 is moved in the direction of the optical axis in accordance with the movement of the spiral shaft.

A collimate lens 62, a polygon mirror (a polygonal reflection mirror) 64, a lens 66, reflection mirrors 68 and 70 and a lens 72 are arranged in a manner corresponding to a laser diode 60 constituting a laser optical system 2*a*, so that a photosensitive drum 50 is irradiated with a laser beam emitted from an exposure device 52.

An image forming unit 2A, i.e., the printer 3 serving as an image forming means is configured by combining, for example, a laser optical system with an electrophotographic system capable of forming an image on a transfer sheet.

That is to say, the printer 3 includes the photosensitive drum 50 serving as an image carrier pivotably supported at substantially the center of the apparatus, and further, includes the exposure device 52, a developer 54, a transfer charger 55, a separating charger 56, a discharger 57 before cleaning, a cleaner 58, a discharging lamp 59 and a charger 61 in this order located around the photosensitive drum 50.

The photosensitive drum 50 is uniformly charged by the charger 61.

In this manner, when the laser beam is emitted from the scanner 2, an image of the document is focused on the photosensitive drum 50, thereby forming an electrostatic latent image.

Moreover, the electrostatic latent image formed on the photosensitive drum 50 is developed by the developer 54, and then, the developed image is transferred, by the transfer charger 55, onto a copying sheet (an image forming medium) P to be fed from a sheet supplying cassette 30 serving as a sheet supplier, described later, via a sheet supplying roller 20 and an aligning roller 25.

The copying sheet P after being transferred by the transfer charger 55 is separated by the effect of an AC charge discharging by the separating charger 56, and then, is conveyed to a fixing device 71 via the conveying belt.

The copying sheet P, on which the developed image is fused and fixed by the fixing device 71, is discharged to a unit 74 having a sheet discharging tray 74*a*, by a pair of sheet discharging rollers 73.

The unit 74 includes a pair of rollers 74*b* for allowing the copying sheet P, which is discharged by the pair of sheet discharging rollers 73, to face down.

Additionally, the unit 74 is provided, at the upper portion thereof, with a stapler 74*c* for stapling one set of sheets in a staple-sort mode.

In the meantime, any developing agent remaining on the photosensitive drum 50, after the developed image is transferred onto the copying sheet P and the copying sheet P is separated, is previously discharged by the discharger 57 before cleaning, followed by cleaning by the cleaner 58, and then, a potential on the photo-sensitive drum 50 is adjusted to a predetermined level or lower by the discharging lamp 59, thereby allowing the next copying operation.

Here, in the case of double-sided copying in which both sides of the copying sheet P are subjected to printing, the copying sheet P, on which the developed image is fused and fixed by the above-described fixing device 71, is fed along a feeding path 75*a*, and then, is stacked on a tray 75*b*.

The sheet P having only one side printed, stacked on the tray 75*b* is fed to the above-described transfer charger 55 along another feeding path 75*c*, and then, the developed image is transferred onto the other side of the sheet P, which has not been printed yet.

Under the tray 75*b* is disposed a sheet sensor 75*d* of a light reflection type, for detecting the presence of the sheet to be stacked on the tray 75*b*.

The feeding path 75*a*, the tray 75*b*, the feeding path 75*c* and the sheet sensor 75*d* constitute an automatic double-sided device (ADD) 75 serving as an automatic double-sided reversing mechanism.

Furthermore, reference numeral 30 in FIG. 1 designates the sheet supplying cassettes 30 serving as the sheet suppliers which are vertically disposed at a plurality of stages in such a manner so as to be detachably attached in front of the copying machine 1.

The sheet supplying cassette 30 consists of a cassette case 31 serving as a casing containing therein the copying sheets P.

The cassette case 31 is configured such that its removal end is inclined toward a sheet taking-out direction.

The uppermost copying sheet P contained in the cassette case 31 of the sheet supplying cassette 30 is first picked up and taken out by a pick-up roller 81.

The copying sheets P taken out by the pick-up roller 81 and fed to the removal end of the cassette case 31 are separated one by one at a sheet separating unit consisting of a sheet supplying roller 84 and a separating roller (or a separating pad) 85 disposed upward inside of the removal end of the cassette case 31, and then, are fed to the printer 3.

Moreover, at the right side of the copying machine are provided a sheet supplying cassette 43 and a large cassette feeder (LCF) 47 in a detachable manner.

The uppermost copying sheet P contained in the sheet supplying cassette 43 is first picked up and taken out by a pick-up roller 43*a*.

The copying sheets P taken out by the pick-up roller 43*a* and fed to the removal end of the sheet supplying cassette 43 are separated one by one at a sheet separating unit consisting of a sheet supplying roller 43*b* and a separating roller 43*c* disposed upward inside of the removal end of the sheet supplying cassette 43, and then, are fed to the printer 3.

The uppermost copying sheet P contained in the LCF 47 is first picked up and taken out by a pick-up roller 47*a*.

The copying sheets P taken out by the pick-up roller 47*a* and fed to the removal end of the LCF 47 are separated one by one at a sheet separating unit consisting of a sheet supplying roller 47*b* and a separating roller 47*c* disposed upward inside of the removal end of the LCF 47, and then, are fed to the printer 3.

In other words, the digital copying machine 1 as a composite image forming apparatus according to the present invention, as shown in FIG. 1, is constituted of the scanner 2 for reading the document and the image forming unit 2A.

The scanner 2 optically scans the document, which has been taken in by the ADF (automatic document feeder) 4 or the like, by using the exposure lamp 6 as a light source, so that the reflection light enters the CCD sensor 11, and then, is read as a digital image signal after A/D conversion.

The image forming unit 2A comprises the photosensitive drum 50, the laser optical system 2*a*, the LCF 47 serving as the sheet supplying tray, the printer 3 including the developing device 54 and the fixing device 5, and the sheet discharging tray 74*a*.

A semiconductor laser disposed inside the laser optical system 2*a* is switched on or off in response to the image signal read by the scanner 2. The laser beam is reflected and scanned by the polygon mirror, and consequently, the electrostatic latent image is formed on the photosensitive drum 50.

After the electrostatic latent image is developed by the developing device 54, it is transferred onto the sheet which is supplied from any of the sheet supplying cassette 30, the sheet supplying cassette 43, the large cassette feeder (LCF) 47 and the tray 75*b* for the automatic double-sided device (ADD) 75 in accordance with the designation of a user, and then, is fixed by the fixing device 71.

In this manner, a sheet having the image formed thereon is thereafter discharged onto the sheet discharging tray 74*a*.

A sheet edge sensor 75*e*, described later, as an essential part according to the present invention is mounted in a fixed or movable manner on the tray 75*b* constituting the automatic double-sided device (ADD) 75 as one example according to the present invention, thereby detecting lateral misalignment of the sheet fed from the tray 75*b* along the feeding path.

The sheet edge sensor 75*e* as the essential part according to the present invention may be disposed not only on the tray 75*b* for the automatic double-sided device (ADD) 75 but also over or on a part of the feeding path, on which the sheet supplied from the above-described sheet supplying cassette 30, sheet supplying cassette 43, large cassette feeder (LCF) 47 or tray 75*b* for the automatic double-sided device 75 is fed to the image forming unit 2A.

Figure 2:
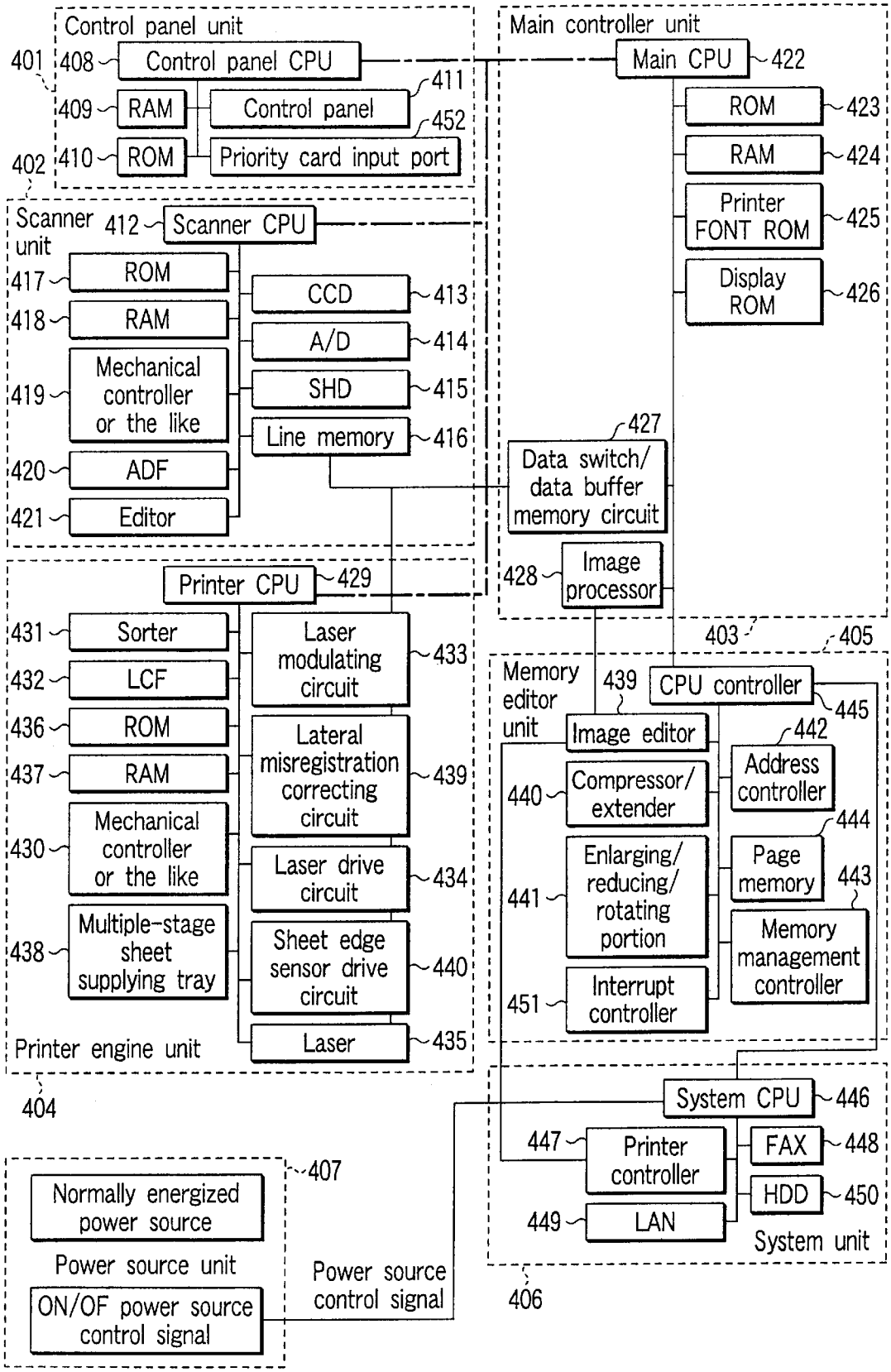
FIG. 2 is a block diagram illustrating the schematic configuration of a control system in the digitally composite machine which is used as the image forming apparatus in a first embodiment according to the present invention.

FIG. 2 is a block diagram illustrating the configuration of a control system in the above-described composite image forming apparatus.

The control system in the present composite image forming apparatus includes mainly a control panel unit 401, a scanner unit 402, a main controller unit 403, a printer engine unit 404, a memory editor unit 405, a system unit 406 and a power source unit 407.

The control panel unit 401 is composed of a control panel CPU 408 for controlling the entire control panel unit 401, a RAM 409, a ROM 410, a control panel 411 and a priority card input port 452.

The scanner unit 402 is composed of a scanner CPU 412 for controlling the entire scanner unit 402, a CCD 413 for reading analog image data transmitted from the scanner, an A/D converting circuit 414 for performing A/D conversion, an SHD circuit 415 for performing shading correction, a line memory 416 for providing timing, a ROM 417, a RAM 418, a mechanic controller 419, an ADF 420 and an editor 421 for a coordinate input device.

The main controller unit 403 is composed of a main CPU 422 for controlling the entire main controller unit 403, a ROM 423, a RAM 424, a printer FONT ROM 425, a display ROM 426, a data switch/data buffer memory circuit 427 for switching where to transmit the data read by the scanner unit 402 or how to transmit the data to the printer engine, and performing buffering and an image processor 428 for performing image edition such as compression or extension.

The main CPU 422 controls also the respective CPUs in the units in addition to the above-described control.

The printer engine unit 404 comprises a mechanical controller or the like 430, a sorter 431, an LCF (a large cassette feeder) 432, a laser modulating circuit 433, a laser drive circuit 434, a laser 435, a ROM 436, a RAM 437, a multiple-stage sheet supplying tray 438, a lateral misalignment correcting circuit 439 for giving a predetermined lateral misalignment correcting signal to the laser modulating circuit 433 or the laser drive circuit 434 based on a detection output transmitted from the above-described sheet edge sensor 75*e* as the essential part according to the present invention, and a sheet edge sensor drive circuit 440.

The memory editor unit 405 is composed of an image editor 439 for editing the image data edited by the image processor 428 and image data transmitted from the system unit 406, a compressor/extender 440 for compressing or extending the data, an enlarging/reducing/rotating portion 441 for performing enlargement, reduction or rotation, a page memory 444 for storing, per page, the image data processed by the above-described editor devices, an address controller 442 for managing a memory address, a memory management controller 443 for managing the data stored in the memory, a CPU controller 445 for linking a system CPU 446 in the system unit 406 to the main CPU 422, and an interrupt controller 451.

The above-described configuration achieves composition or the like per page.

The system unit 406 comprises the system CPU 446 for controlling the entire system unit and the memory editor unit 405, a printer controller 447 for converting data transmitted from a personal computer or the like into image data, a facsimile (a FAX) 448, a local area network (a LAN) 449, and a hard disk drive (a HDD) 450.

The composite image forming apparatus according to the present invention comprises the memory editor unit 405, the printer controller 447, the FAX 448, the LAN 449 and the HDD 450, in which electric power supply is controlled in accordance with an electric power mode, the system CPU (periphery) 446 for controlling the above-described optional devices, the main controller unit 403 for receiving a command in accordance with the electric power mode from the system CPU (periphery) 446 so as to control the power source unit 407, and the power source unit 407 including an electric power system for supplying continuous electric power and another electric power system, which can be controlled by the system CPU (the periphery) 446, in order to supply the electric power in accordance with the electric power mode.

Figure 3:
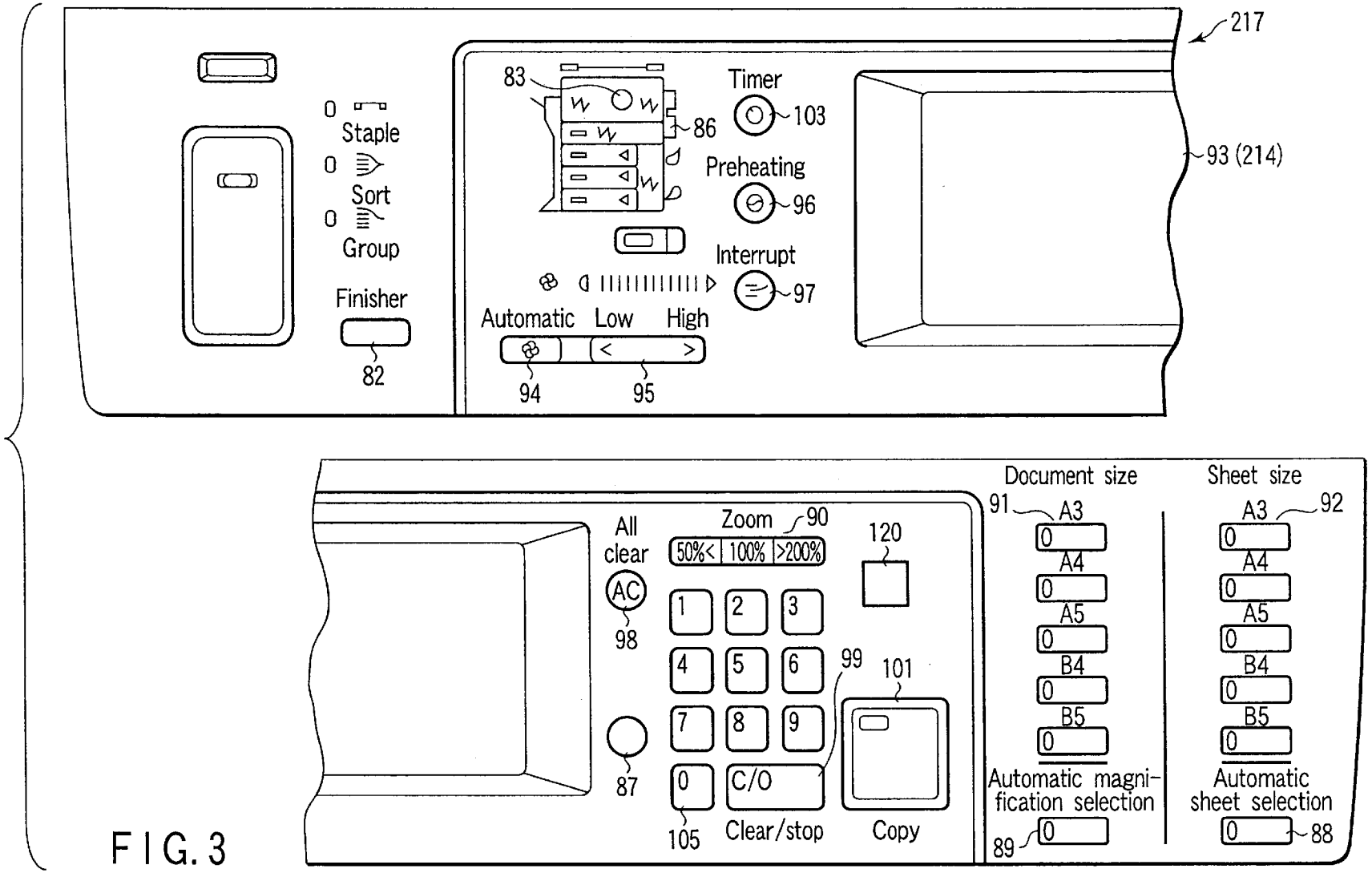
FIG. 3 is a diagram illustrating the details of a console panel unit and a display unit illustrated in FIG. 2.

FIG. 3 is a diagram illustrating the details of a console unit 217 and a display unit 214.

In other words, FIG. 3 illustrates the configuration of the console panel (control panel) 217 serving as an operating device.

Namely, the console panel 217 includes a finisher key 82, a state display 83, a cassette selecting key 86 for selecting the sheet supplying cassette 30, a HELP key 87, an automatic sheet selecting key 88, an automatic magnification selecting key 89, a zoom/100% key 90, a document size key 91, a sheet size key 92, a message display 93, an automatic density key 94, a manual density key 95, a preheating key 96, an interrupt key 97, an all-clear key 98, a clear/stop key 99, a start key 101, a timer key 103, a ten key 105 and a function switching key 120.

The finisher key 82 is used in selecting a sort mode, a group mode or a staple mode.

The state display 83 is provided for displaying the state of the copying machine by flashing or displaying various pictorial characters.

The cassette selecting key 86 is depressed to select another cassette when the cassette for a desired size is not selected.

When the HELP key 87 is depressed as an operation guide key, a message representing operating procedures is displayed, and further, when it is depressed after a function is set, the set contents can be confirmed.

The automatic sheet selecting key 88 is normally set in an automatic sheet selecting mode. The size of the document placed on the document (glass) stage, not illustrated, is automatically detected, and then, a sheet having the same size as the detected size is automatically selected (only in copying under an equal magnification).

An automatic magnification selecting mode is selected by depressing the automatic magnification selecting key 89 and a desired sheet size is designated, the size of the document placed on the document (glass) stage 5 is detected, and then, a copying magnification is automatically calculated.

The copying magnification is decremented by 1% down to 50% by depressing a "50%<" key of the zoom/100% key 90.

In contrast, the copying magnification is incremented by 1% up to 200% by depressing a ">200%" key of the zoom/100% key 90.

Furthermore, the copying magnification is returned to an equal magnification (100%) by depressing a "100%" key of the zoom/100% key 90.

The document size key 91 is used in setting the document size.

That is, when the sheet size is selected and the document size is designated by depressing the document size key 91, the copying magnification is automatically set.

The sheet size key 92 is used in selecting the sheet size.

The message display 93 as the display unit 214 displays, with characters and pictures, the state of the digital copying machine 1, the operating procedures and various commands to a user.

The message display 93 as the display unit 214 may incorporate a touch panel therein so as to set functions.

When the automatic density key 94 is depressed, the digital copying machine 1 automatically detects the density of the document so as to select an optimum copying density.

A desired copying density can be selected by depressing the manual density key 95.

The copying density can be reduced by five levels by depressing a "low" key; in contrast, the copying density can be increased by five levels by depressing a "high" key.

The copying machine is brought into a preheating state (a power saving state) by depressing the preheating key 96, and therefore, all of display lamps are extinguished.

In order to restart the copying operation, the preheating key 96 is depressed again.

The interrupt key 97 is used when interrupt copying is intended to be performed during continuous copying.

When the all-clear key 98 is depressed, all of the selected modes are cleared, so that the copying machine is returned to a standard state.

The clear/stop key 99 is used to vary the number of sheets to be printed or stop the copying operation.

The start key 101 is depressed to start the copying operation.

The time when the power source of the digital copying machine 1 is turned on or off is displayed by depressing the timer key 103 (in the case where a weekly timer is set).

The ten key 105 is used to set the number of sheets to be printed, which can be set from 1 to 999.

The function switching key 120 is used to switch functions such as a facsimile function and a printer function, which are equipped in the composite digital copying machine.

First Embodiment

Figure 4:
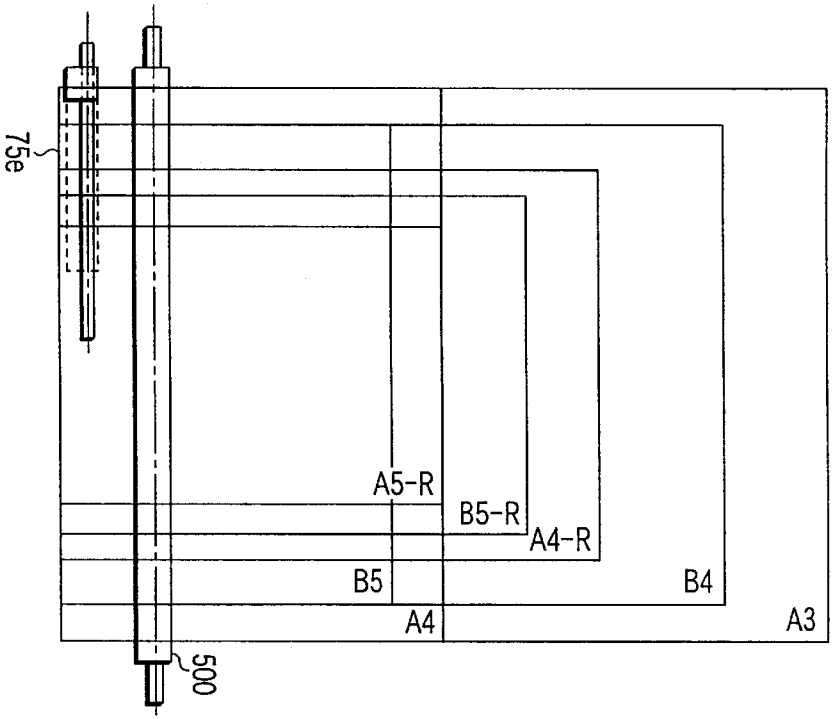
FIG. 4 is a diagram schematically illustrating the positional relationship between a sheet edge sensor 75*e* as an essential part according to the present invention and a sheet in the case where the sheet edge sensor 75*e* is disposed in a fixed or movable manner.

FIG. 4 is a diagram schematically illustrating the positional relationship between the sheet edge sensor 75*e* as the essential part according to the present invention and the sheet in the case where the sheet edge sensor 75e is disposed in a fixed or movable manner.

Namely, it is assumed that a sheet having any one of sizes A3, B4, A4-R, B5-R and A5-R is fed along the feeding path while keeping a symmetric positional relationship with respect to a center line in a longitudinal direction, as illustrated in FIG. 4, and that a sheet having either one of sizes A4 and B5 is fed while keeping the symmetric positional relationship with respect to a center line in the direction of the width, as illustrated in FIG. 4.

Consequently, in order to detect lateral misalignment of the sheet having any one of the above-described sizes to be fed in the above-described manner, the sheet edge sensor 75*e* is disposed in a fixed or movable manner at a position corresponding to substantially half of a distance from an edge to the center line in a direction perpendicular to the feeding path, as illustrated in FIG. 4, thereby detecting lateral misalignment of the sheet having any one of the above-described sizes.

Here, in FIG. 4, reference numeral 500 designates, for example, an ADU registration roller for feeding the sheet having any one of the above-described sizes (hereinafter the same).

Figure 5:
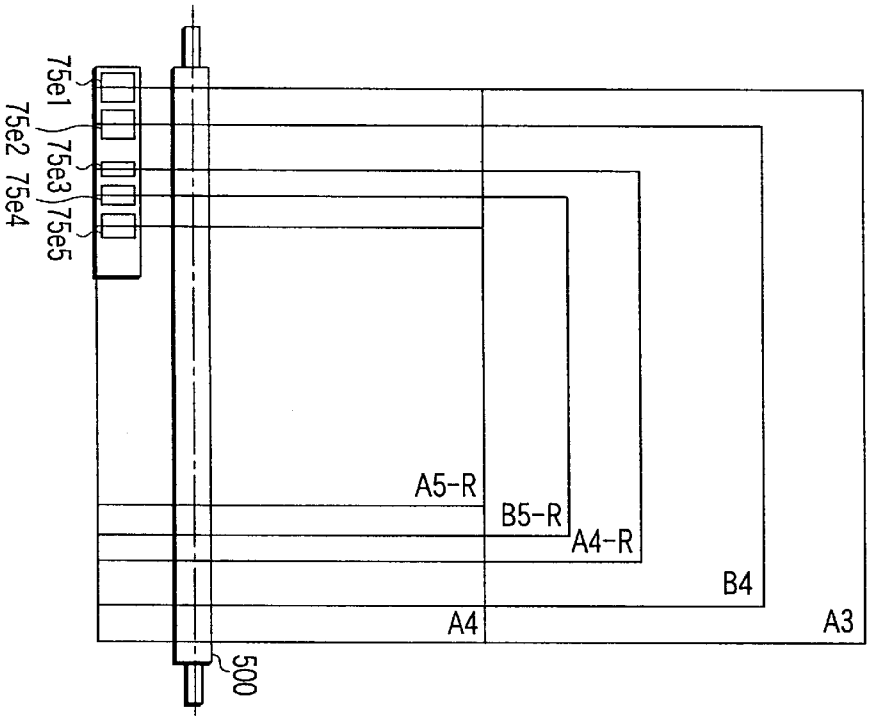
FIG. 5 is a diagram schematically illustrating the positional relationship between the sheet edge sensor 75*e* as the essential part according to the present invention and the sheet in the case where the sheet edge sensor 75*e* is disposed in the fixed manner in the first embodiment according to the present invention.

FIG. 5 is a diagram schematically illustrating the positional relationship between the sheet edge sensor 75*e* as the essential part according to the present invention and the sheet in the case where the sheet edge sensor 75*e* is disposed in the fixed manner in a first embodiment according to the present invention.

In this case, the sheet edge sensor 75*e* of the fixed type includes a first sheet edge sensor 75*e*1 for detecting the edge of a sheet having a size A4 or A3, a second sheet edge sensor 75*e*2 for detecting the edge of a sheet having a size B4, a third sheet edge sensor 75*e*3 for detecting the edge of a sheet having a size A4-R, a fourth sheet edge sensor 75*e*4 for detecting the edge of a sheet having a size B5-R and a fifth sheet 25 edge sensor 75*e*5 for detecting the edge of a sheet having a size A5-R, each of which is sequentially disposed at the partly predetermined position corresponding to substantially half of the distance from the edge to the center line in the direction perpendicular to the feeding path.

Each of these first to fifth sheet edge sensors 75*e*1 to 75*e*5 is a light reflection type sensor with a size of about 10 mm, and consists of a light emitting diode serving as a light source and a photo diode serving as a light receiving element.

In the state in which the sheet having a predetermined size is fed along the feeding path, as described above, the edge of the sheet is detected by any one of the first to fifth sheet edge sensors 75*e*1 to 75*e*5, and therefore, the amount of lateral misalignment of the sheet can be determined by the lateral misalignment correcting circuit 439 provided in the printer engine unit 404 illustrated in FIG. 2 based on a regular edge position and the actually detected edge position.

That is to say, the lateral misalignment correcting circuit 439 provided in the printer engine unit 404 corrects the amount of lateral misalignment of the sheet determined based on a detection output transmitted from the sheet edge sensor 75*e*, and then, transmits a predetermined lateral misalignment correcting signal to the laser modulating circuit 433, the laser drive circuit 434 or the like in such a manner as to correctly position the image formed on the sheet.

Thus, even if a lateral misalignment occurs of a sheet having a predetermined size fed along the feeding path, the lateral misalignment can be corrected, so that the image of the document can be correctly-positioned on the sheet.

Second Embodiment

Figure 6:
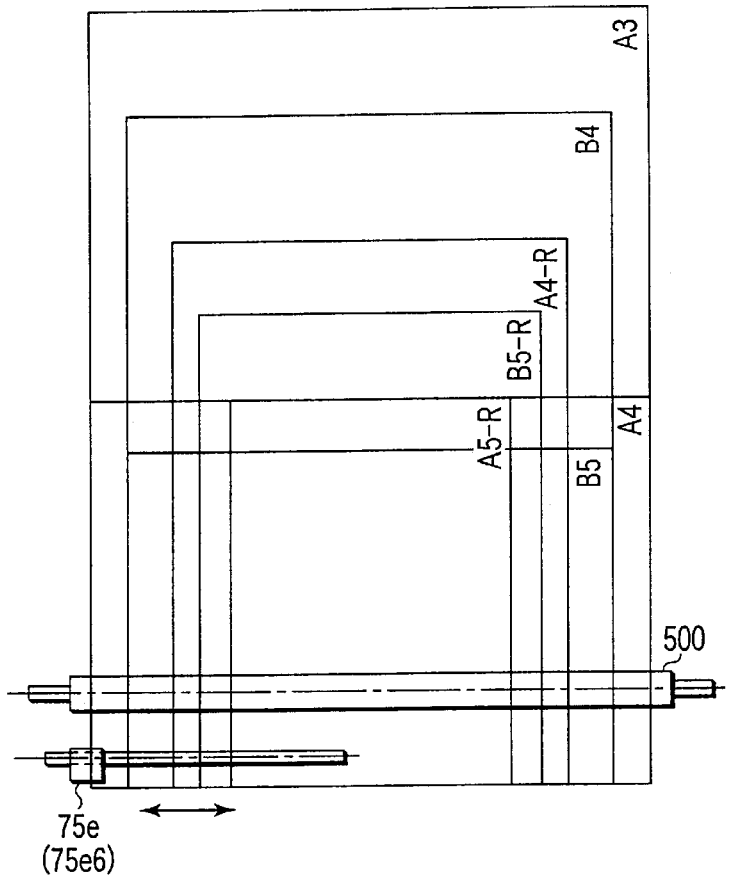
FIG. 6 is a diagram schematically illustrating the positional relationship between the sheet edge sensor 75*e* as the essential part according to the present invention and the sheet in the case where the sheet edge sensor 75*e* is disposed in the movable manner in a second embodiment according to the present invention.

FIG. 6 is a diagram schematically illustrating the positional relationship between the sheet edge sensor 75*e* as the essential part according to the present invention and the sheet, in the case where the sheet edge sensor 75*e* is disposed in the movable manner in a second embodiment according to the present invention.

In this case, the sheet edge sensor 75*e* of the movable type is a single sheet edge sensor 75*e*6 movably disposed at the position corresponding to substantially half of the distance from the edge to the center line in the direction perpendicular to the feeding path.

Like the above-described first to fifth sheet edge sensors 75*e*1 to 75*e*5, the single sheet edge sensor 75*e*6 is a light reflection type sensor with a size of about 10 mm, and consists of a light emitting diode serving as a light source and a photo diode serving as a light receiving element.

Furthermore, the single sheet edge sensor 75*e*6 includes a sensor for starting the operation of the sheet edge sensor.

Figure 7:
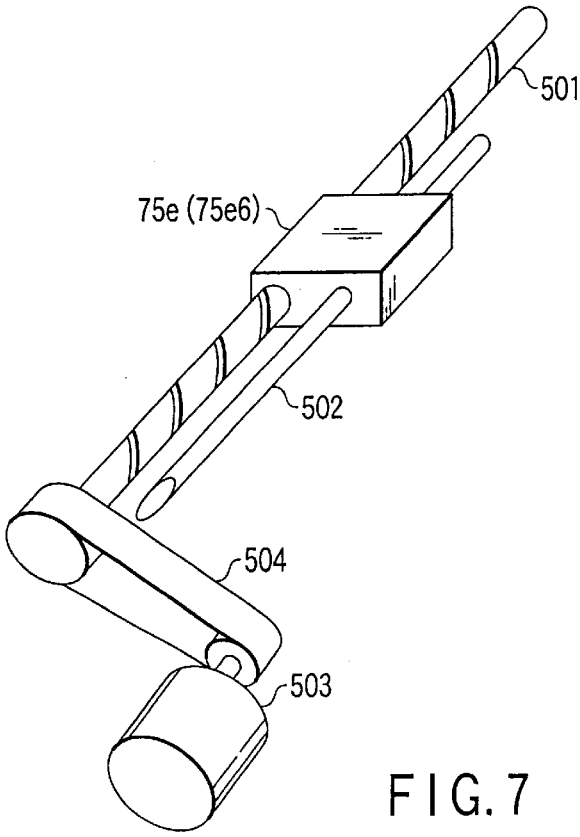
FIG. 7 is a perspective view showing an example of a moving mechanism in the case where the sheet edge sensor 75*e* as the essential part according to the present invention is disposed in the movable manner.

FIG. 7 is a perspective view showing an example of a moving mechanism in the case where the sheet edge sensor 75*e* as the essential part according to the present invention is disposed in the movable manner.

Namely, the moving mechanism is constituted of a spirally grooved rod 501, which supports the above-described single sheet edge sensor 75*e*6 and extends in the direction perpendicular to the feeding path, a guide shaft 502, and a belt mechanism 504 for transmitting the drive force from a stepping motor 503 to the spirally grooved rod 501.

Figure 8:
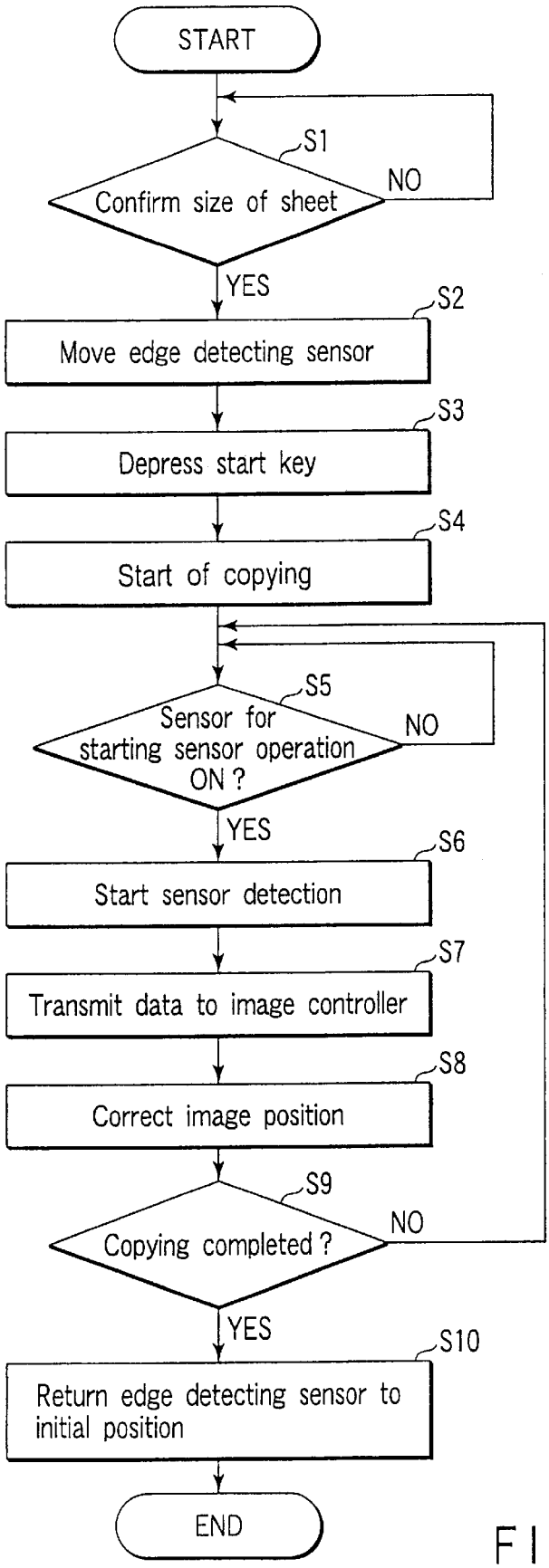
FIG. 8 is a flowchart illustrating operation in the case where the sheet edge sensor 75*e* as the essential part according to the present invention is disposed in the movable manner.

FIG. 8 is a flowchart illustrating operation in the case where the sheet edge sensor 75*e* as the essential part according to the present invention is disposed in the movable manner.

The sheet edge sensor 75*e* of the movable type is driven by the sheet edge sensor drive circuit 440 provided in the printer engine unit 404 illustrated in FIG. 2.

When the user depresses the size key 91 on the console panel 217 illustrated in FIG. 3, the main CPU 422 illustrated in FIG. 2 judges whether or not the size of the sheet is confirmed in the case where the size of the sheet is designated or the size of the sheet is automatically set (step S1).

When the size of the sheet is confirmed in the above-described manner, the single sheet edge sensor element 75*e*6 serving as the sheet edge sensor 75*e* of the movable type is moved to a position for the designated size of the sheet (for example, in FIG. 6, the partly predetermined position corresponding to substantially half of the distance from the edge to the center line in the direction perpendicular to the feeding path signifies any one of a first position at which the edge of the sheet having the size A4 or A3 is detected, a second position at which the edge of the sheet having the size B4 is detected, a third position at which the edge of the sheet having the size A4-R is detected, a fourth position at which the edge of the sheet having the size B5-R is detected, and a fifth position at which the edge of the sheet having the size A4-R is detected) by the sheet edge sensor drive circuit 440 provided in the printer engine unit 404 illustrated in FIG. 2 and the moving mechanism illustrated in FIG. 7 (step S2).

When the user depresses the copy (start) key 101 on the console panel 217 illustrated in FIG. 3 (step S3), a copying operation is started (step S4).

Subsequently, it is judged whether or not the sensor for starting the operation of the sheet edge sensor included in the single sheet edge sensor 75*e*6 is ON (step S5).

Here, if the sensor for starting the operation of the sheet edge sensor is ON, the single sheet edge sensor 75*e*6 which has been moved to the predetermined position, as described above, starts detecting the sheet edge (step S6).

When the single sheet edge sensor 75*e*6 detects the sheet edge in this manner, the amount of lateral misalignment of the sheet can be determined based on the difference between the regular edge position and the actually detected edge position in the lateral misalignment correcting circuit 439 provided in the printer engine unit 404.

That is to say, the lateral misalignment correcting circuit 439 provided in the printer engine unit 404 corrects the amount of lateral misalignment of the sheet determined based on a detection output transmitted from the sheet edge sensor 75*e*, and then, transmits data for giving a predetermined lateral misalignment correcting signal to the laser modulating circuit 433, the laser drive circuit 434 or the like in such a manner as to form the image of the document correctly-positioned on the sheet (step S7).

Thus, even if lateral misalignment occurs in a sheet having a predetermined size fed along the feeding path, lateral misalignment can be corrected, so that the image of the document can be correctly-positioned on the sheet (step S8).

Thereafter, it is judged whether or not the copying operation is completed (step S9).

Here, when it is judged that the copying operation is completed, the single sheet edge sensor 75*e*6 which has been moved to the predetermined position, as described above, is returned to its initial position (step S10).

Third Embodiment

Figure 9:
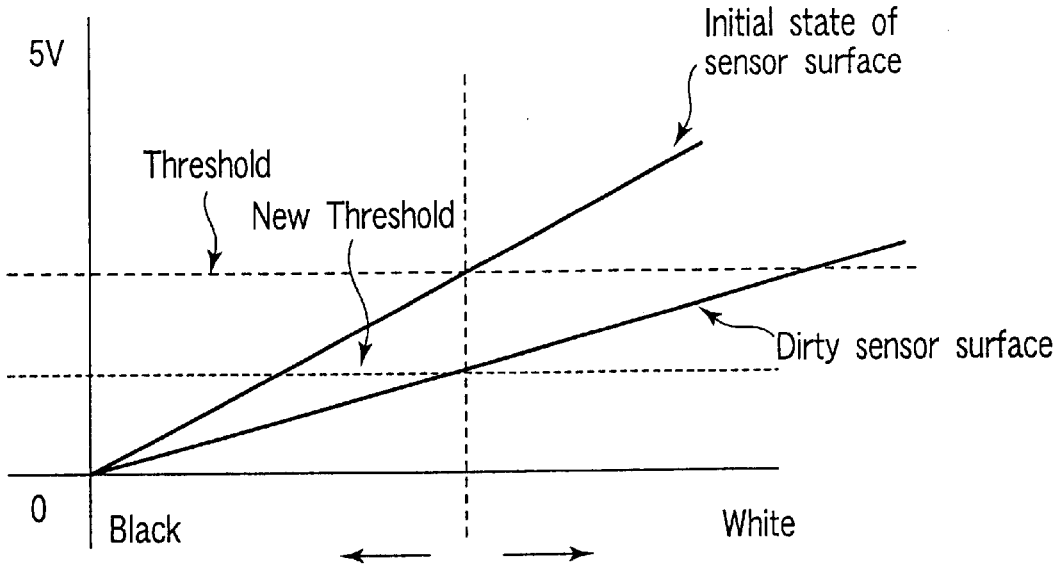
FIG. 9 is a graph illustrating re-setting of a threshold as a judgment criterion of the presence of a sheet on the precondition for sheet edge detection in accordance with a smear on the sheet edge sensor as the essential part according to the present invention in a third embodiment according to the present invention.

FIG. 9 is a graph illustrating re-setting of a threshold as a judgment criterion of the presence of the sheet on the precondition for sheet edge detection in accordance with a smear on the sheet edge sensor as the essential part according to the present invention in a third embodiment according to the present invention.

As illustrated in FIG. 9, the readable intensity of light is reduced when the surface of the sensor is dirty. Therefore, if the sensor is used as the surface of the sensor is not cleared, a voltage cannot reach a threshold as a judgment criterion of the presence of the sheet on the precondition for the sheet edge detection, thereby resulting in the judgment that there is no sheet even if there is actually a sheet.

In view of this, in the third embodiment according to the present invention, the threshold as the judgment criterion of the presence of the sheet on the precondition for the sheet edge detection is adjusted to be lower than an initial value before the sheet is actually detected, as illustrated in FIG. 9, thus reducing erroneous detection of the presence of the sheet.

Accordingly, it becomes unnecessary to provide control or a mechanism for removing the smear from the surface of the sensor.

Moreover, in the case where a plurality of sheets are copied, the threshold is adjusted with respect to each of the plurality of sheets in the above-described manner, thus further increasing the accuracy.

Fourth Embodiment

Figure 10:
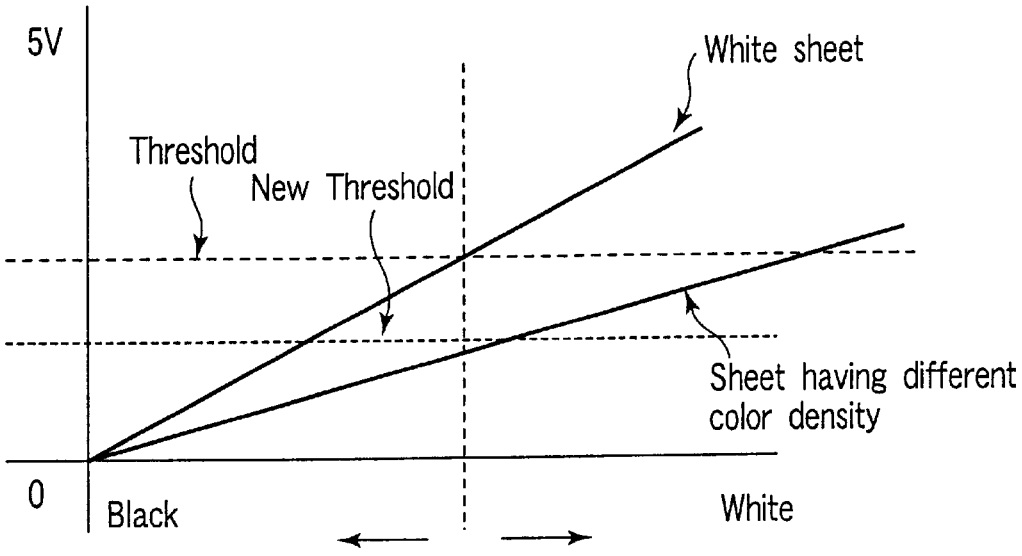
FIG. 10 is a graph illustrating re-setting of a threshold as a judgment criterion of the presence of a sheet on the precondition for the sheet edge detection by the sheet edge sensor as the essential part according to the present invention in accordance with the color of the sheet in a fourth embodiment according to the present invention.

FIG. 10 is a graph illustrating re-setting of a threshold as a judgment criterion of the presence of the sheet on the precondition for the sheet edge detection by the sheet edge sensor as the essential part according to the present invention in accordance with the color of the sheet in a fourth embodiment according to the present invention.

As illustrated in FIG. 10, the readable intensity of light is changed according to the brightness of the color of the sheet in the case of a reflection type sensor. If a sheet of a dark color is used, a detected voltage becomes low.

Consequently, an output from the sensor cannot reach a threshold voltage, thereby resulting in the judgment that there is no sheet even if there is actually a sheet.

In view of this, in the fourth embodiment according to the present invention, the color of the sheet is previously designated, and then, erroneous detection caused by the color of the sheet can be prevented by resetting the threshold as the judgment criterion of the presence of the sheet according to the color.

Moreover, in the case when a plurality of sheets are copied, the threshold is adjusted with respect to each of the plurality of sheets in the above-described manner, thus further increasing the accuracy.

Fifth Embodiment

Figure 11:
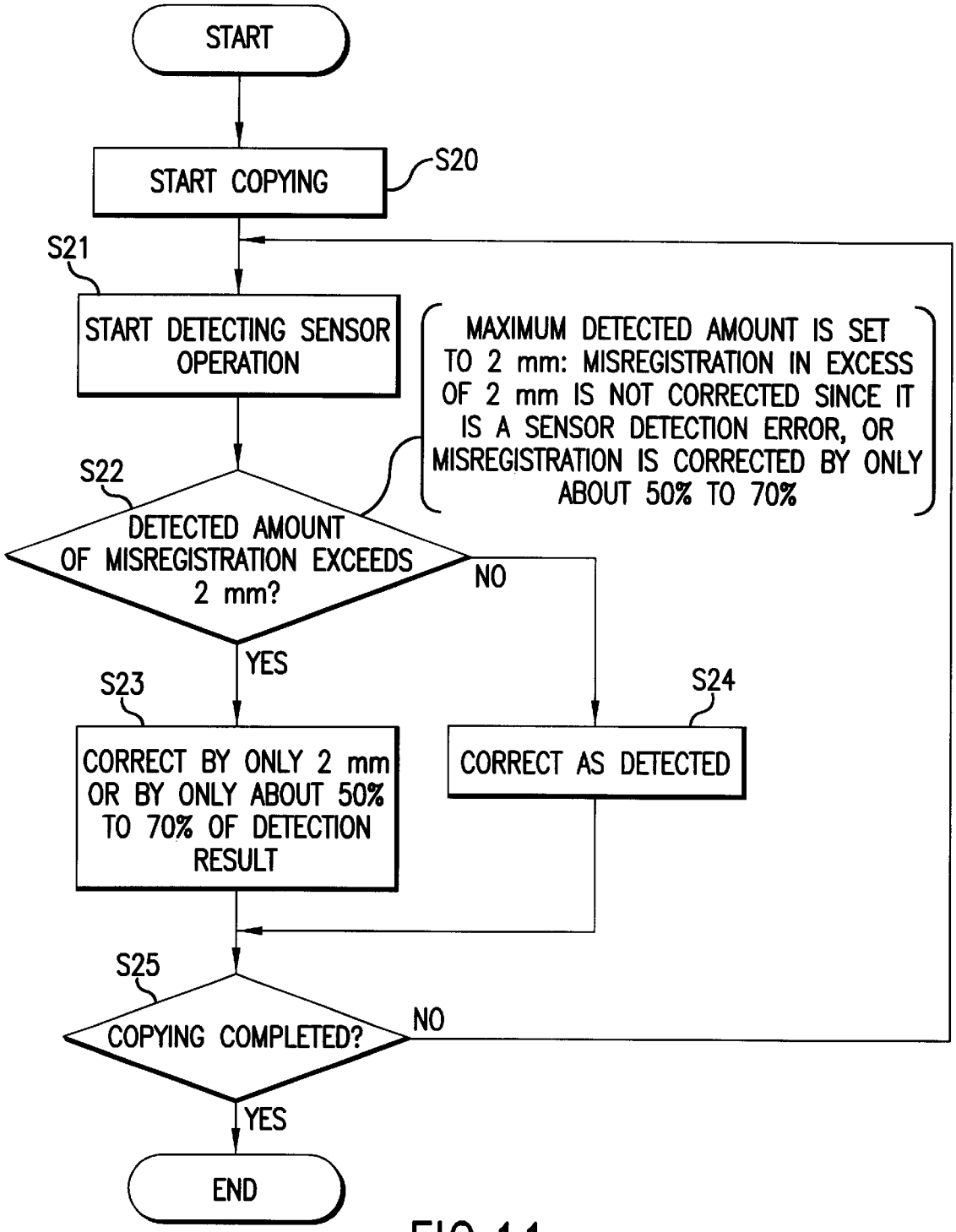
FIG. 11 is a flowchart illustrating operation for limiting correction in forming an image based on a detection result by the sheet edge sensor as the essential part according to the present invention in a fifth embodiment according to the present invention.

FIG. 11 is a flowchart illustrating operation for limiting correction in forming an image based on the detection result by the sheet edge sensor as the essential part according to the present invention in a fifth embodiment according to the present invention.

In consideration of the estimated maximum amount of lateral misalignment of the sheet in the case where no sheet edge detecting sensor is provided, detection of the amount of misalignment in excess of the maximum amount of misalignment by the sheet edge detecting sensor seems to be a detection error by the sheet edge detecting sensor.

At this time, if the misalignment is corrected based on the detection result, an image to be formed differs largely.

In view of this, in the fifth embodiment according to the present invention, in the case where the maximum amount is set to, for example, 2 mm, a detection result is judged to be erroneous if the detection result exceeds 2 mm. There is provided a limitation such that only the amount of 2 mm or less is corrected, or only 50% to 70% of the detection result is corrected, thereby reducing an influence of erroneous operation caused by the detection error.

That is to say, as illustrated in FIG. 11, after the copying operation is started (step S20), the sheet edge sensor is started to be operated (step S21), and then, it is judged whether or not the detected amount of misalignment exceeds 2 mm based on the detection result (step S22).

Here, if the detected misalignment exceeds 2 mm, there is provided a limitation such that the misalignment is corrected by only the amount of 2 mm or less, or the misalignment is corrected by only 50% to 70% of the detection result (step S23).

In contrast, if the detected misalignment is less than 2 mm, the misalignment is corrected in accordance with the detection result (step S24).

The routine is ended when the completion of the copying operation is judged (step S25).

Incidentally, the present invention is featured also in that the threshold as the judgment criterion of the presence of the sheet on the precondition for the sheet edge detection can be effectively corrected, as described above, by using the photo diode of an analog output type as the sheet edge sensor.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a sheet feeding unit provided with a feeding path, on which a cut sheet serving as an image forming medium having a predetermined size is fed;

a sheet edge sensor having sensor elements separately arranged at portions, at which the edge of the cut sheet serving as the image forming medium having the predetermined size can be detected, along a direction perpendicular to the feeding direction of the cut sheet serving as the image forming medium on the feeding path in the sheet feeding unit;

an image forming unit for forming a predetermined image on the cut sheet serving as the image forming medium to be fed by the sheet feeding unit; and an image formation correcting unit for correcting image formation according to lateral misalignment of the cut sheet serving as the image forming medium based on a detection result transmitted from the sheet edge sensor when a predetermined image is formed on the cut sheet serving as the image forming medium by the image forming unit, wherein when the presence of the sheet is detected based on the detection result transmitted from the sheet edge sensor, the image formation correcting unit adjusts a threshold as a judgment criterion of the presence of the sheet before actual detection of the sheet by the sheet edge sensor, and when the presence of the sheet is detected based on the detection result transmitted from the sheet edge sensor, the image formation correcting unit previously designates a color of the sheet, and then, resets the threshold as the judgment criterion of the presence of the sheet in accordance with the designated color.

2. An image forming apparatus according to claim 1, wherein when the amount of lateral misalignment of the sheet is corrected based on the detection result transmitted from the sheet edge sensor, the image formation correcting unit judges as to whether or not the detected amount of misalignment exceeds a predetermined value, and then, gives a limitation to correction of the lateral misalignment of the sheet in the case where the detected amount of misalignment exceeds the predetermined value.

3. An image forming apparatus comprising:

a sheet feeding unit provided with a feeding path, on which a cut sheet serving as an image forming medium having a predetermined size is fed;

a sheet edge sensor having a sensor element movably arranged at a portion, at which the edge of the cut sheet serving as the image forming medium having the predetermined size can be detected, along a direction perpendicular to the feeding direction of the cut sheet serving as the image forming medium on the feeding path in the sheet feeding unit;

an image forming unit for forming a predetermined image on the cut sheet serving as the image forming medium to be fed by the sheet feeding unit; and an image formation correcting unit for correcting image formation according to lateral misalignment of the cut sheet serving as the image forming medium based on a detection result transmitted from the sheet edge sensor when a predetermined image is formed on the cut sheet serving as the image forming medium by the image forming unit, wherein when the presence of the sheet is detected based on the detection result transmitted from the sheet edge sensor, the image formation correcting unit adjusts a threshold as a judgment criterion of the presence of the sheet before actual detection of the presence of the sheet by the sheet edge sensor, and when the presence of the sheet is detected based on the detection result transmitted from the sheet edge sensor, the image formation correcting unit previously designates a color of the sheet, and then, resets the threshold as the judgment criterion of the presence of the sheet in accordance with the designated color.

4. An image forming apparatus according to claim 3, wherein when the amount of lateral misalignment of the sheet is corrected based on the detection result transmitted from the sheet edge sensor, the image formation correcting unit judges as to whether or not the detected amount of misalignment exceeds a predetermined value, and then, gives a limitation to correction of the lateral misalignment of the sheet in the case where the detected amount of misalignment exceeds the predetermined value.

5. A method for controlling an image forming apparatus comprising the steps of:

feeding a cut sheet serving as an image forming medium having a predetermined size along a feeding path provided in a sheet feeding unit;

separately arranging sensor elements constituting a sheet edge sensor at portions, at which the edge of the cut sheet serving as the image forming medium having the predetermined size can be detected, along a direction perpendicular to the feeding direction of the cut sheet serving as the image forming medium on the feeding path in the sheet feeding unit;

forming a predetermined image on the cut sheet serving as the image forming medium to be fed to an image forming unit by the sheet feeding unit; and correcting image formation according to lateral misalignment of the cut sheet serving as the image forming medium based on a detection result transmitted from the sheet edge sensor when a predetermined image is formed on the cut sheet serving as the image forming medium by the image forming unit;

wherein when the amount of lateral misalignment of the sheet is corrected based on the detection result transmitted from the sheet edge sensor, it is judged as to whether or not the detected amount of misalignment exceeds a predetermined value, and then, a limitation is given to correction of the lateral misalignment of the sheet in the case where the detected amount of misalignment exceeds the predetermined value in the image formation correcting step.

6. A method for controlling an image forming apparatus according to claim 5, wherein when the presence of the sheet is detected based on the detection result transmitted from the sheet edge sensor, a threshold as a judgment criterion of the presence of the sheet is adjusted in the image formation correcting step before actual detection of the presence of the sheet by the sheet edge sensor.

7. A method for controlling an image forming apparatus according to claim 6, wherein when the presence of the sheet is detected based on the detection result transmitted from the sheet edge sensor, a color of the sheet is previously designated, and then, the threshold as the judgment criterion of the presence of the sheet is reset in accordance with the designated color in the image formation correcting step.

8. A method for controlling an image forming apparatus comprising the steps of:

feeding a cut sheet serving as an image forming medium having a predetermined size along a feeding path provided in a sheet feeding unit;

moving a sensor element constituting a sheet edge sensor at a portion, at which the edge of the cut sheet serving as the image forming medium having the predetermined size can be detected, along a direction perpendicular to the feeding direction of the cut sheet serving as the image forming medium on the feeding path in the sheet feeding unit;

forming a predetermined image on the cut sheet serving as the image forming medium to be fed to an image forming unit by the sheet feeding unit; and correcting image formation according to lateral misalignment of the cut sheet serving as the image forming medium based on a detection result transmitted from the sheet edge sensor when a predetermined image is formed on the cut sheet serving as the image forming medium by the image forming unit, wherein when the amount of lateral misalignment of the sheet is corrected based on the detection result transmitted from the sheet edge sensor, it is judged as to whether or not the detected amount of misalignment exceeds a predetermined value, and then, a limitation is given to correction of the lateral misalignment of the sheet in the case where the detected amount of misalignment exceeds the predetermined value in the image formation correcting step.

9. A method for controlling an image forming apparatus according to claim 8, wherein when the presence of the sheet is detected based on the detection result transmitted from the sheet edge sensor, a threshold as a judgment criterion of the presence of the sheet is adjusted in the image formation correcting step before actual detection of the presence of the sheet by the sheet edge sensor.

10. A method for controlling an image forming apparatus according to claim 9, wherein when the presence of the sheet is detected based on the detection result transmitted from the sheet edge sensor, a color of the sheet is previously designated, and then, the threshold as the judgment criterion of the presence of the sheet is reset in accordance with the designated color in the image formation correcting step.

* * * * *